United States Patent [19]

Carminati et al.

[11] Patent Number: 4,878,654

[45] Date of Patent: Nov. 7, 1989

[54] METHOD FOR COOLING GASES AND/OR VAPORS FROM NON-FERROUS METAL TREATMENT PLANTS, AND THE RELATIVE APPARATUS

[75] Inventors: Antonio Carminati, Milan; Andrea Perillo, Rome, both of Italy

[73] Assignee: Snamprogetti S.p.A., Milan, Italy

[21] Appl. No.: 95,003

[22] Filed: Sep. 2, 1987

[30] Foreign Application Priority Data

Sep. 2, 1986 [IT] Italy ..... 21566 A/86

[51] Int. Cl.[4] ..... F22D 1/04

[52] U.S. Cl. ..... 266/159; 122/7 R; 122/379

[58] Field of Search ..... 266/44, 155, 158, 159; 75/7; 122/7 R, 379

[56] References Cited

U.S. PATENT DOCUMENTS

| | | | |
|---|---|---|---|
| 3,320,931 | 5/1967 | Durham | 266/155 |
| 3,997,000 | 12/1976 | Piela | 122/379 |
| 4,076,223 | 2/1978 | Schempp | 266/158 |

*Primary Examiner*—Robert McDowell

*Attorney, Agent, or Firm*—Birch, Stewart, Kolasch & Birch

[57] ABSTRACT

A method and apparatus for cooling gases and/or vapors from non-ferrous metal treatment plants, wherein gases and/or vapors which develop in the treatment region are passed parallel to a heat transfer surface consisting of one or more sets of vertical tubes disposed in intimate mutual contact to form a shaft structure, the tubes being fed with water under pressure to produce steam, and the shaft structure being suspended above the treatment region.

11 Claims, 3 Drawing Sheets

1
2
3
4
5
6
7
10
11
13
22

METHOD FOR COOLING GASES AND/OR VAPORS FROM NON-FERROUS METAL TREATMENT PLANTS, AND THE RELATIVE APPARATUS

The present invention relates to a method and apparatus for cooling gases and/or vapors from non-ferrous metal treatment plants.

More particularly, the present invention relates to a method and apparatus for cooling high-temperature gases and/or metal vapors present in plants for the roasting and smelting of ores for the production of non-ferrous metals. Still further, the present invention relates to a method and apparatus for cooling high-temperature gases and/or metal vapors present in lead ore roasting plants.

In the description given hereinafter, reference will be often made to the particular case note above. However, the method and apparatus of the present invention are not to be taken in any way as limited to the cooling of vapors and gases originating from lead ore treatment plants.

Lead ore treatment comprises concentrating the lead contained in the extracted mineral by known means, to a concentration of between 60% and 80%.

Most lead concentrates consist of galena with various impurities. In addition to lead, the concentrates contain Ag, Zn, Fe, Cu, Cd, Bi, Sb, Mn, S, $SiO_2$, $Al_2O_3$, CaO, MgO and $BaSO_4$ in addition to other trace elements.

The concentrate is roasted to desulphurize it by converting the PbS into oxide, and it then undergoes a smelting or reduction stage to convert the oxide into impure metal (work lead), and finally it undergoes refining to separate impurities of commercial value. During the roasting stage, there is a considerable development of vapors and gases consisting essentially of:

| | |
|---|---|
| $SO_2$ | 27–37% by volume |
| $CO_2$ | 25–35% by volume |
| $N_2$ | 15–25% by volume |
| $O_2$ | 5–10% by volume |
| PbO vapour | 3–6% by volume |
| and in addition: | |
| dust | 400–800 g/Nm$^3$ |

The temperature of this mass of gases, vapors and dust (hereinafter called "offgas", the term "offgas" signifying any stream of gases, vapours and dust present in ore treatment plants) is generally between 1100° C. and 1300° C.

The invention, therefore, relates to the treatment of this offgas to recover its heat content.

The known art in this respect comprises feeding the offgas to a conventional boiler comprising pressurized water tubes arranged in a horizontal conduit.

The drawbacks of the conventional boiler are essentially the following:

(1) the high frequency of maintenance for removing the incrustation which deposits on the tubes and for replacing tubes which have corroded or been eroded by the offgas (2) the fact that the boiler is external to the roasting plant, so that crusts which deposit on the bottom must be recycled to the roasting region by mechanical means; and (3) the pressure drop undergone by the offgas through the feed pipe and boiler, as this pressure drop results in dust and vapor deposits along the path.

It has been surprisingly found that the drawbacks of the known art can be obviated by using an offgas heat recovery system disposed above the roasting region.

A first aspect of the present invention is a method for cooling offgas which develops in non-ferrous metal treatment (roasting) plants, characterized in that the offgas stream is passed parallel to a heat transfer surface consisting of one or more sets of vertical tubes disposed side-by-side in intimate mutual contact, forming a shaft structure, the tubes being fed with pressurized water to form steam, the shaft structure being suspended above the treatment region and having a cross-section equal or substantially equal to that of the upper part of the treatment region, the tubes of the shaft structure being provided with percussion means for shaking-off the impurities which deposit on the surfaces, the shaft structure being in sealed connection with the treatment region.

In implementing the method according to the present invention, the offgas is cooled from a temperature of 1100°–1300° C. to a temperature of less than 550° C.

In the case of lead, the sulphur oxide vapours present in the offgas and the lead oxides present therein react within the temperature range of 700°–900° C. to form lead sulphate with the development of heat which is also removed during cooling.

The method according to the present invention, which as stated uses offgas cooling by indirect heat transfer with water to be vaporized through vertically disposed tubes, has considerable advantages over the prior art, and of these the following deserve mention:

(1) energy is recovered from the offgas without having to feed the offgas through pipes to a boiler;

(2) heat transfer is facilitated because the vertical tubes are hardly subjected to incrustations and deposits, so that heat transfer is constant with time;

(3) the outlet temperature of the offgas can be carefully controlled, so that the metal dust entrained by the offgas is dry and not sticky;

(4) the non-ferrous ore treatment plant can operate continuously without having to be shut down for the cleaning or repair of conventional boilers;

(5) automatic cleaning of the heat transfer surfaces during operation, by percussion;

(6) the surrounding working environment is completely isolated from the roasting and offgas energy recovery region, and there is no need for manual intervention as both temperatures and incrustations can be automatically monitored by sensors with reliability;

(7) high operational flexibility according to the production requirements of the roasting region;

(8) use of a percussion cleaning system disposed on the outside of the shaft tube structure, so that the system does not come into contact with the offgas and does not deteriorate;

(9) the offgas flow path does not suffer any angular deviation, so as to avoid any blockage to its passage;

(10) the ability to keep the offgas velocity very low because of the large cross-sectional area of the shaft structure; and

(11) the ability to use large-thickness, small-diameter tubes, so as to increase plant life and reduce their susceptibility to soiling on the gas side.

A second aspect of the present invention is an apparatus suitable for implementing the aforesaid method. The apparatus comprises a process chamber in which the non-ferrous ore treatment (in particular roasting) is carried out, and a gas outlet chamber generally of rectangular or square shape, the walls of the gas outlet chamber being constructed of refractory material, in particular chrome-magnesia, with interspersed cooling elements, particularly made of copper. The edge of the gas outlet chamber is formed from a cooling element, particularly of copper, and is characterized in that a vertical metal structure disposed about the gas outlet chamber supports at its upper end, by means of metal ties or other known means fixed to one or more horizontal bars connected to said metal structure, a cooling "shaft" formed from walls consisting of one or more sets of vertical tubes disposed side-by-side in intimate mutual contact. These walls delimit the conduit defined by the cooling shaft. The shaft has a cross-section equal or substantially equal to that of the edge of the gas outlet chamber, each vertical tube being fed, through its own nozzle, with pressurized water from one or more headers. The water evaporates to cool the gases and/or vapors generated during the non-ferrous ore treatment, and the steam is then discharged from the end distant from the feed end. The metal structure disposed about the chamber supports a second vertical metal structure adjacent or adhering to the cooling shaft.

In a preferred embodiment of the apparatus according to the present invention, the vertical metal structure adjacent or adhering to the cooling shaft terminates at a fixed ledge which supports a wall composed of a suitable number of courses generally from 3 to 6 and preferably 4 of refractory bricks, and in particular, chrome-magnesia bricks. Their purpose is to protect that lower part of the metal structure adjacent or adhering to the shaft which is exposed to gas at the highest temperature.

According to the first preferred embodiment, the cooling tube shaft extends downwardly to at least partially cover the said wall.

In a second preferred embodiment of the apparatus according to the present invention, the cooling element at the upper edge of the chamber is connected to the lower edge of the metal structure adjacent or adhering to the cooling shaft by a wall having a suitable number of refractory brick courses, preferably 4, particularly made of chrome-magnesia, having an upper soft layer of ceramic wool which enables the system expansion to be absorbed. This aforesaid wall can be partly removed to allow the insertion of a water-cooled gate valve for shutting the inlet of the cooling shaft.

In a third preferred embodiment of the apparatus according to the present invention, the headers for feeding pressurized water to the individual tubes are situated in an elevated position with respect to the lower part of the cooling shaft, and that part of the cooling shaft below the headers is in the form of tubes bent to a U-shaped configuration at their bottom to form a skirt. These tubes then rise normally upwards as far as the steam collection headers. In the apparatus according to the present invention, the heat transfer surfaces of the cooling shaft are cleaned by hammer percussion devices with their anvil fixed to the set of tubes on their external side not in contact with the offgas, and their hammer fixed to the metal structure adjacent or adhering to the shaft.

In addition to the aforesaid components, the apparatus according to the present invention can also comprise in the upper part of the cooling shaft auxiliary heat transfer surfaces formed from flat tubes disposed parallel to the gas and/or vapor flow fixed to one or more support bars rigidly connected to the metal structure disposed about the gas outlet chamber.

The screens can be extracted either individually or all together. These additional heat transfer surfaces are cleaned by hammer percussion devices of the aforesaid type, with their anvil fixed to the support bars and their hammer connected to the metal structure adhering to the screens.

When the offgas has been cooled in the apparatus according to the present invention, it is fed for dust removal to an electrostatic filter, and an emergency stack closed by a motorized gate valve is provided in the offgas feed pipe to the electrostatic filter. A second motorized gate valve can shut off this pipe so as to allow maintenance of the electrostatic filter under safety conditions.

The offgas inlet temperature to the filter is controlled by inblown atmospheric air.

The control air nozzles can be closed by tight-shutting valves to prevent any exit of harmful gas. Each nozzle can also be swabbed from the outside while the plant is running.

BRIEF DESCRIPTION OF THE DRAWINGS

The apparatus according to the present invention will now be described with reference to the accompanying drawings wherein:

In FIGS. 1 and 2, two tubes forming part of a wall facing the observer are shown, together with the visible tube of that set of tubes perpendicular to the the wall facing the observer.

FIGS. 1 and 2 do not show the metal structure external to the chamber. In these figures there is illustrated a tube of that set of tubes 1 of the wall facing the observer within a cooling shaft 15 (FIG. 3), a header 2 for feeding pressurized water to the tubes, a nozzle 3 for feeding pressurized water to a tube, an internal metal structure 4 adjacent or adhering to the cooling shaft, a hammer percussion device 5 with its anvil fixed to the tubes on their external surface which is not in contact with the offgas, with the hammer fixed to the metal structure adjacent or adhering to the shaft, an expansion joint 6 between the evaporator tubes 1 and the metal structure 4, four courses of bricks 7 which protect the lower edge 11 of the metal structure, which is exposed to high temperature offgas, and a soft layer 8 of ceramic wool above the four courses of bricks 9 which form the connection between the last cooling element 10 of the gas outlet chamber 13 and the lower edge 11 of the base of the metal structure adjacent or adhering to the shaft.

A water-cooled gate valve 22 closes the cooling shaft.

Figure 1:
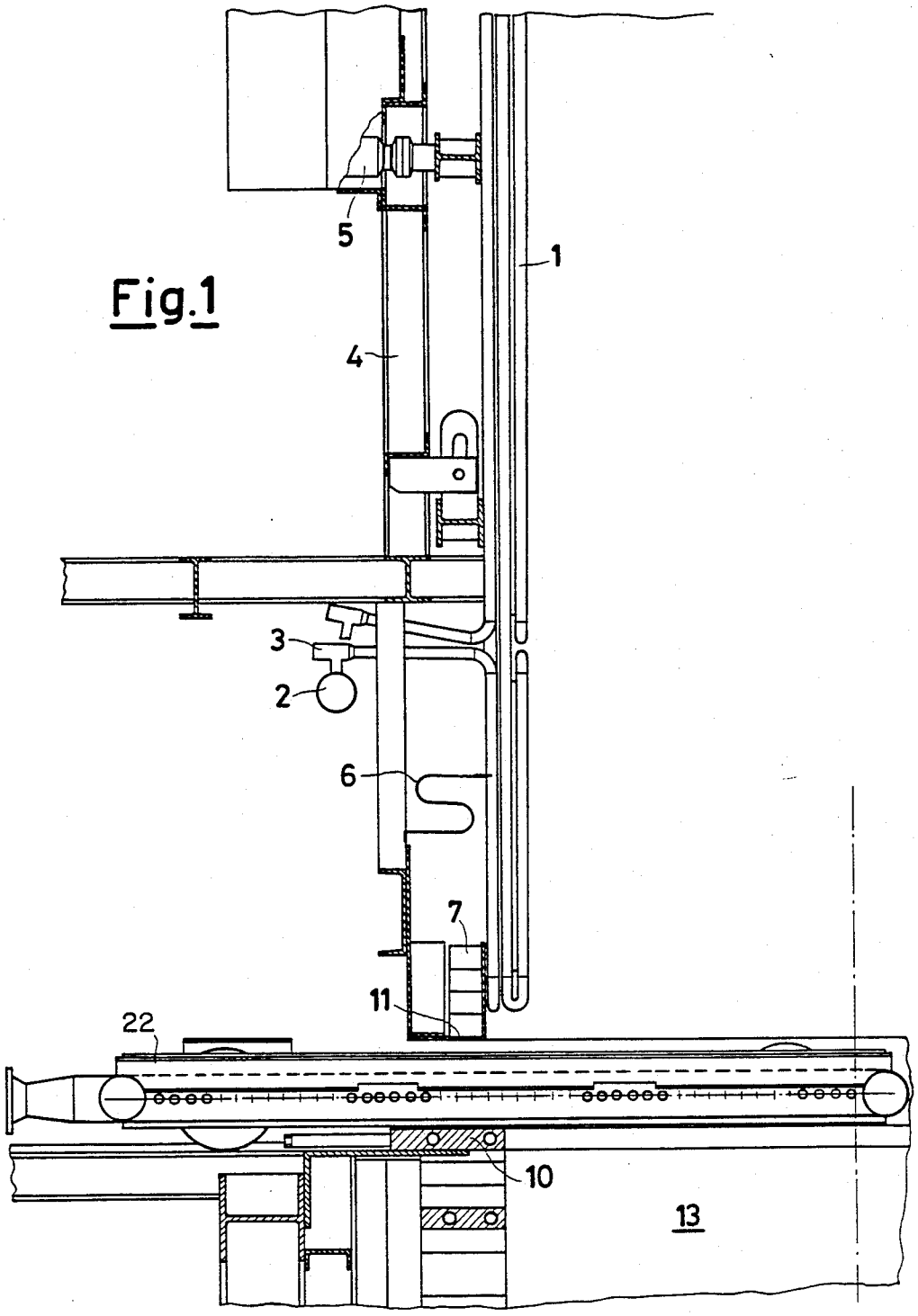
FIGS. 1 and 2 show a cross section through part of the apparatus according to the present invention in the vicinity of the gas outlet chamber.
Figure 2:
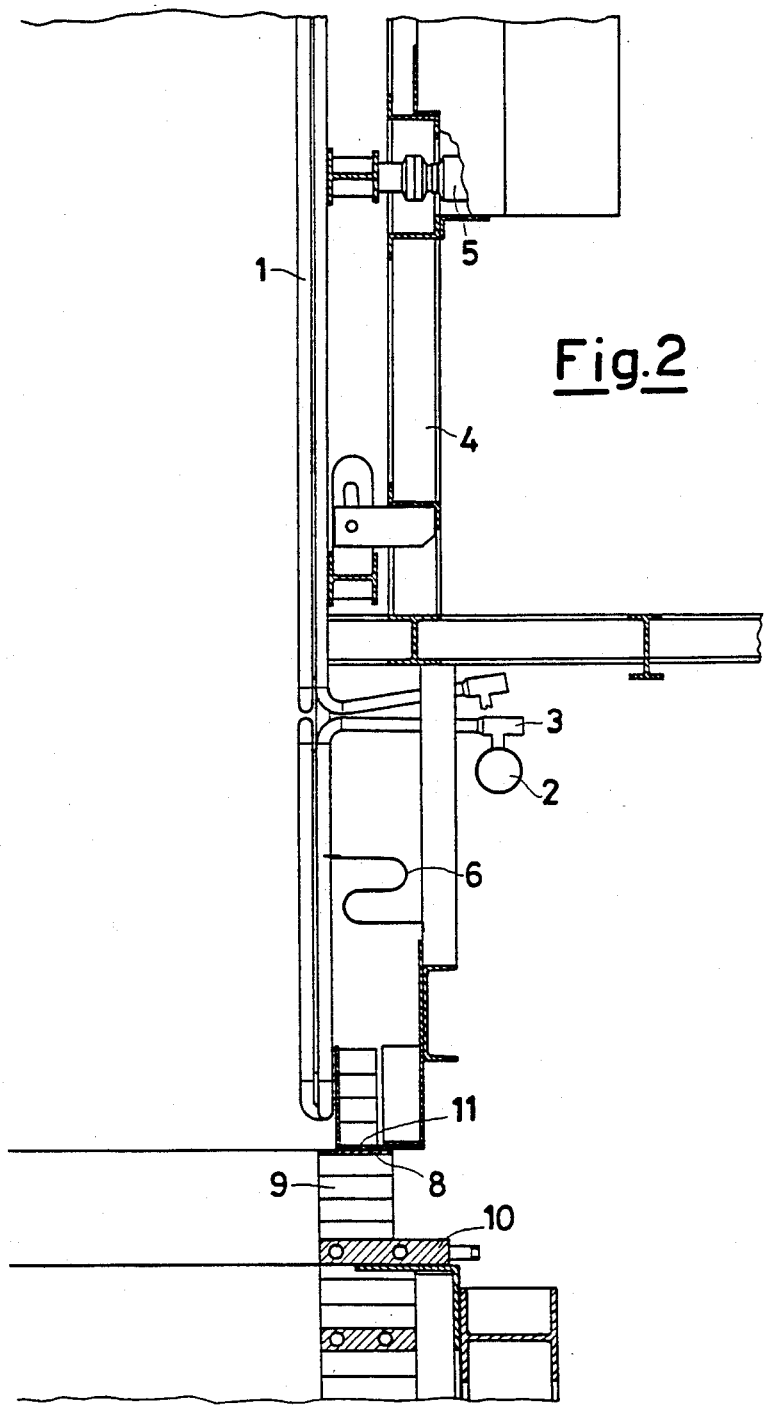
Figure 3:
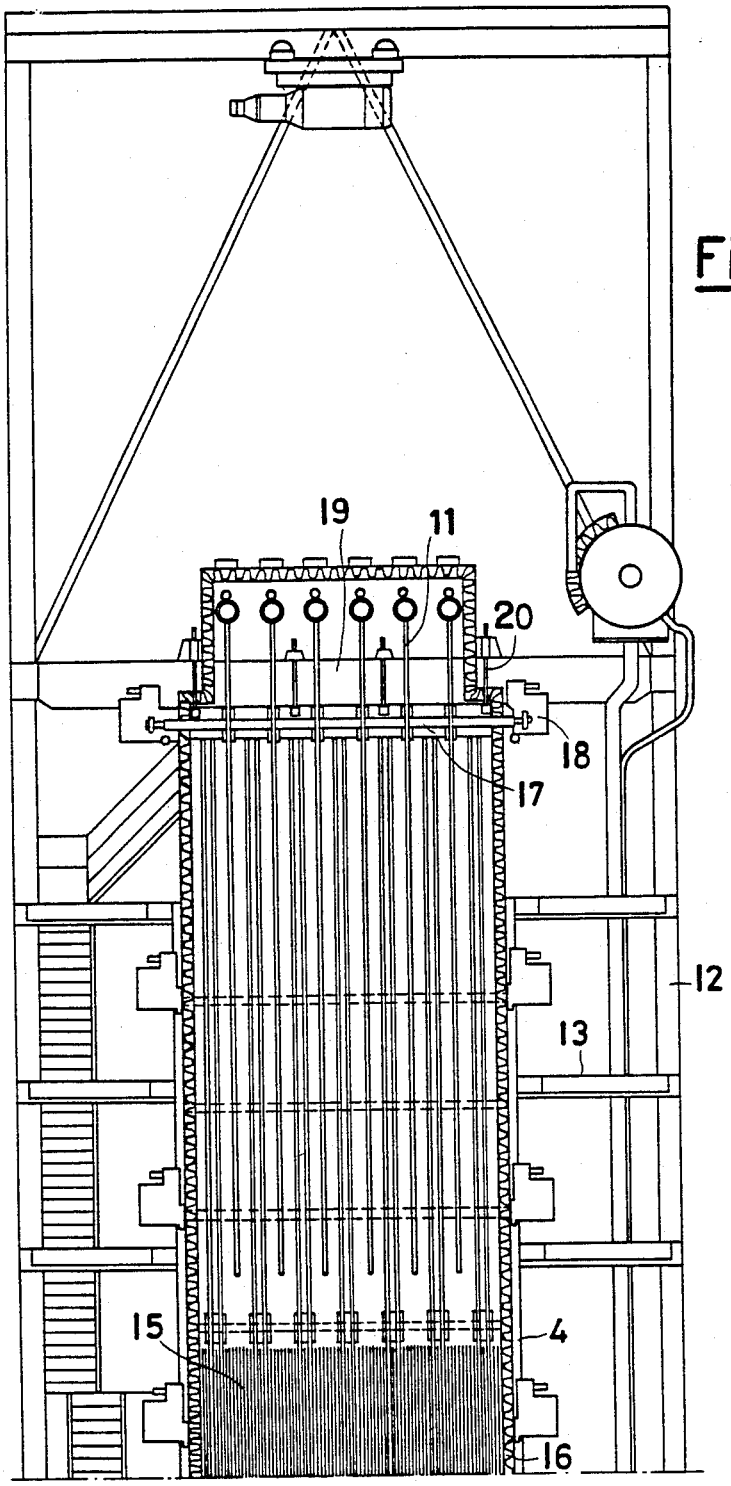
FIG. 3 shows a cross section through the upper part of the apparatus according to the present invention. obtained by viewing FIGS. 1 and 2 placed together, with FIG. 1 to the left and FIG. 2 to the right.

FIG. 3 shows a cross section through the upper part of the apparatus according to the present invention.

In it, auxiliary flat heat transfer screens 11 disposed inside the cooling shaft in a direction parallel to the gas and vapor flow are visible.

Also visible are the external metal structure 12 disposed about the chamber, and supports 13 connecting the external metal structure 12 disposed about the chamber to the internal metal structure 4 adjacent or adhering to the cooling shaft 15. An insulating layer 16 is placed between the internal metal structure adjacent to the cooling shaft and the cooling shaft 15 itself. Support bars 17 for the auxiliary screens 11, an anvil 18 against which the hammer 5 beats for cleaning the screens, and a bar 19 which supports the shaft tie bars 20 are also seen.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

We claim:

1. An apparatus for cooling offgas which is produced in non-ferrous metal treatment plants and recovering the heat from said offgas which comprises:

a roasting chamber in which the non-ferrous ore treatment is carried out, an offgas heat recovery chamber disposed above said roasting chamber and having a cross section substantially equal to the upper part of said roasting chamber, said offgas heat recovery chamber comprising a plurality of vertically positioned tubes with surfaces disposed side-by-side in intimate mutual contact to define a cooling shaft structure through which high temperature offgases flow to be cooled, a vertical metal support structure disposed adjacent to or adhering to said cooling shaft structure, said support structure terminating at a lower end thereof in a fixed ledge which supports a wall composed of one or more courses of refractory bricks which protect said lower end of said metal structure from said high temperature offgases, header means for introducing pressurized water into said vertically positioned tubes, means for recovering heated water or steam from said tubes, and percussion means for engaging with said tubes for shaking-off impurities which deposit on said tube surfaces whereby because said offgas heat recovery chamber is disposed above said roasting chamber, the impurities which are loosened from the tube surfaces caused by the percussion means fall back into the roasting chamber.

2. The apparatus of claim 1, wherein the number of courses of refractory bricks is between 3 and 6.

3. The apparatus of claim 1, wherein the refractory bricks are chrome-magnesia bricks.

4. The apparatus of claim 1 wherein the cooling shaft extends downwards to at least partly cover the wall for the lower end of the metal structure adjacent to or adhering to the cooling shaft.

5. The apparatus of claim 1 wherein the upper edge of the roasting chamber comprises a cooling element which is connected to the lower edge of the metal structure adjacent to or adhering to the cooling shaft by a wall having one or more courses of refractory bricks and having an upper soft layer of refractory wool.

6. The apparatus of claim 5, wherein the number of refractory brick courses is 4.

7. The apparatus of claim 5, wherein the bricks are chrome-magnesia bricks.

8. The apparatus of claim 1 wherein headers for feeding pressurized water to the individual tubes of the cooling shaft are situated in an elevated position with respect to the lower part of the cooling shaft, and part of the cooling shaft below said headers is in the form of tubes bent to a U-shape configuration at their bottom to form a skirt.

9. The apparatus of claim 1 wherein the percussion means for cleaning the heat transfer surfaces of the cooling tubes are hammer percussion devices with their anvil portion fixed to the tubes on their external side not in contact with the offgas, and their hammer portion fixed to the metal structure adjacent to or adhering to the cooling shaft.

10. The apparatus of claim 1 wherein the upper part of the cooling shaft contains auxiliary heat transfer surfaces formed from flat screens which are disposed inside the cooling shaft structure substantially parallel to the offgas flow.

11. The apparatus of claim 10, wherein said flat screens are cleaned by hammer percussion devices having their anvils fixed to support bars for said auxiliary flat screens and their hammer to the metal structure adjacent to or adhering to the cooling shaft.

* * * * *